US009196207B2

(12) United States Patent
Lee

(10) Patent No.: US 9,196,207 B2
(45) Date of Patent: Nov. 24, 2015

(54) SYSTEM AND METHOD FOR CONTROLLING THE SLEW RATE OF A SIGNAL

(75) Inventor: Yongman Lee, Pleasanton, CA (US)

(73) Assignee: APPLE INC., Cupertino, CA (US)

( * ) Notice: Subject to any disclaimer, the term of this patent is extended or adjusted under 35 U.S.C. 154(b) by 782 days.

(21) Appl. No.: 13/100,003

(22) Filed: May 3, 2011

(65) Prior Publication Data

US 2012/0280965 A1 Nov. 8, 2012

(51) Int. Cl.
*G09G 3/36* (2006.01)

(52) U.S. Cl.
CPC ..... *G09G 3/3677* (2013.01); *G09G 3/3696* (2013.01); *G09G 2320/0223* (2013.01); *G09G 2320/0252* (2013.01)

(58) Field of Classification Search
CPC ..... G09G 2320/0023; G09G 3/3677; G09G 2320/0223; H03G 1/0023; H03G 1/0029; H03K 17/04206; H03K 17/166; H03K 2217/0036; H03F 2203/45248
USPC ..... 345/100, 98; 327/170, 561; 330/253
See application file for complete search history.

(56) References Cited

U.S. PATENT DOCUMENTS

| | | | | |
|---|---|---|---|---|
| 5,656,969 | A * | 8/1997 | Pulvirenti et al. | 327/561 |
| 6,462,527 | B1 * | 10/2002 | Maneatis | 323/315 |
| 6,943,786 | B1 * | 9/2005 | Birk et al. | 345/204 |
| 7,030,670 | B2 * | 4/2006 | Lin | 327/170 |
| 7,339,430 | B2 * | 3/2008 | Chiu | 330/253 |
| 7,429,972 | B2 | 9/2008 | Choi et al. | |
| 7,830,351 | B2 * | 11/2010 | Wang et al. | 345/100 |
| 8,519,934 | B2 * | 8/2013 | Huang et al. | 345/100 |
| 2006/0001640 | A1 * | 1/2006 | Lee | 345/100 |
| 2007/0176913 | A1 * | 8/2007 | Satou | 345/204 |
| 2008/0180174 | A1 * | 7/2008 | Kim et al. | 330/253 |
| 2010/0013558 | A1 * | 1/2010 | Chen et al. | 330/261 |

FOREIGN PATENT DOCUMENTS

EP 684699 B1 10/2001

OTHER PUBLICATIONS

Lin et al.; "A High Driving Capability CMOS Buffer Amplifier for TFT-LCD Source Drivers," Engineering Letters, vol. 15, No. 2,; 4 pgs.; online publication Nov. 17, 2007.

* cited by examiner

*Primary Examiner* — Quan-Zhen Wang
*Assistant Examiner* — Xuemei Zheng
(74) *Attorney, Agent, or Firm* — FLETCHER YODER PC

(57) ABSTRACT

Techniques for controlling the slew rate of a signal independently of RC time constants are disclosed. In one embodiment, a gate driver circuit for an LCD panel may include a rail-to-rail operational amplifier having an output stage configured to produce a gate activation signal for switching pixels of the LCD panel. A slew rate control circuit may be provided for adjusting the slew rate of the gate activation signal by varying a bias current of the output stage relative to a compensation capacitance and a gain of the operational amplifier. For instance, the slew rate may be increased by increasing the bias current, and decreased by decreasing the bias current without the need to adjust RC variables.

28 Claims, 9 Drawing Sheets

SYSTEM AND METHOD FOR CONTROLLING THE SLEW RATE OF A SIGNAL

BACKGROUND

The present disclosure relates generally to liquid crystal displays (LCDs) and, more specifically, to techniques for controlling the slew rate of gate driving signals for LCDs.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Display devices are commonly used in conjunction with or as a component of an electronic device to provide visual feedback to a user. One type of display is a liquid crystal display (LCD), which typically includes rows and columns of thin-film-transistors (TFTs) arranged in an array adjacent a layer of liquid crystal material, wherein the TFTs represent image pixels. The LCD may be configured to selectively modulate the amount and color of light passing through each of the pixels by a varying an electric field associated with each respective pixel to control the orientation of the liquid crystals. By controlling the amount of light that may be emitted from each pixel, the LCD, in conjunction with a color filter array, may cause a viewable color image to be displayed.

During operation of an LCD, the gate of a TFT associated with a pixel may be switched on upon receiving a gate activation signal provided by a gate driver circuit. When the TFT is switch on, a data voltage applied to the source of the TFT may be stored as a charge in a pixel electrode coupled to the TFT. By way of example, the TFTs within the pixel array may be switched on sequentially one row at a time, and image data corresponding to a selected row may be sent to the pixels of the selected row when it is activated. When the gate activation signal transitions to cause a TFT of the selected row to switch between on and off states, rise and fall transition time properties (e.g., slew rate) of gate activation signal may influence and affect channel charge distribution behavior of the TFT. For instance, when a TFT is switched from an on state to an off state, charge remaining in the channel of the transistor is redistributed between a corresponding pixel electrode and source line.

To improve image quality, it may be desirable to cause more of the remaining channel charge to be distributed to the source line rather than the pixel electrode. The portion of the channel charge distributed to the pixel electrode, which may be referred to as an error charge, may sometimes result in voltage kickback errors occurring at the pixel. Generally, the amount of error charge distributed to the pixel electrode is proportional to the slew rate of the gate activation signal applied to the TFT. Thus, as the slew rate, which may be expressed as a change in volts per unit of time (e.g., milliseconds, microseconds, nanoseconds, etc.), of the gate signals increases (e.g., becoming faster and resulting in shorter rising/falling transition times), more error charge may be distributed to the pixels of the LCD, which may cause certain visual artifacts, such as flicker, to occur more frequently and/or severely due to the effects of voltage kickback error. Such artifacts may be perceived as aesthetically unpleasing to a user viewing an image on the display. For slower slew rates, more of the channel charge may be redistributed to the source line than to the pixel electrode, which may help to reduce artifacts caused by the effects of voltage kickback. Accordingly, for at least the reasons discussed above, it may be desirable to design and provide an LCD display that is capable of regulating or otherwise setting the slew rate of gate activation signals supplied to TFTs, such that excess channel charge is distributed between source lines and pixel electrodes in a way that reduces the effects of voltage kickback errors and improves image quality.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments described below relate generally to techniques for controlling the slew rate of a signal independently of resistive (R) and capacitive (C) time constant variables. Such techniques may be applied, for example, to a gate activation signal generated by a gate driving circuit of an LCD panel to control the switching of pixels within the LCD panel. For instance, in one embodiment, the gate activation signal may be produced at the output stage of a rail-to-rail operational amplifier. A slew rate control circuit may be provided for adjusting the slew rate of the gate activation signal by varying a bias current of the output stage relative to a compensation capacitance and a gain of the operational amplifier. For instance, the slew rate may be increased by increasing the bias current, and decreased by decreasing the bias current. These techniques may provide for adjustment of the slew rate without the need to adjust capacitance or resistance values corresponding to RC time constants.

Further, the adjustment of the slew rate of a gate activation signal may be used to control channel charge behavior as a transistor (e.g., TFT) switches from an on state to an off state. For instance, as a TFT is switched off, charge present in the channel is distributed between the source line and a pixel electrode. Generally, it is desirable to prevent too much charge from being distributed to the pixel electrode, as this may potentially cause artifacts (e.g., flicker) related to the effects of voltage kickback error to appear on the display. Further, the amount of channel charge distributed to the pixel electrode is directly proportional to the slew rate of the gate activation signal, i.e., for higher slew rates (e.g., meaning faster transition times), more channel charge may be imparted to the pixel electrode. Thus, by controlling the slew rate of the gate activation signal using the techniques and embodiments disclosed herein, the occurrence of artifacts due to voltage kickback effects may be mitigated.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. The embodiments discussed below are intended to be examples that are illustrative in nature and should not be construed to mean that the specific embodiments described herein are necessarily preferential in nature. Additionally, it should be understood that references to "one embodiment," "an embodiment," "some embodiments," and the like are not intended to be interpreted as excluding the existence of additional embodiments that also incorporate the disclosed features.

The present disclosure relates generally to techniques for controlling the slew rate of a clock signal, such as a gate activation signal for controlling the switching of an array of TFT-pixels in an LCD display panel. In one embodiment, gate driver circuitry may include a rail-to-rail operational amplifier having an output stage configured to output the gate activation signal. The output stage may be controlled using a slew rate control circuit configured to vary a bias current in order to adjust the slew rate of the gate activation signal. For instance, the slew rate in such a circuit may be determined as a ratio of the bias current to an effective capacitance (e.g., compensation capacitance multiplied by the op-amp gain). Thus, by varying the bias current, the slew rate of the gate activation signal may be controlled without the need to modify other variables, such as R and C time constants.

Figure 1:
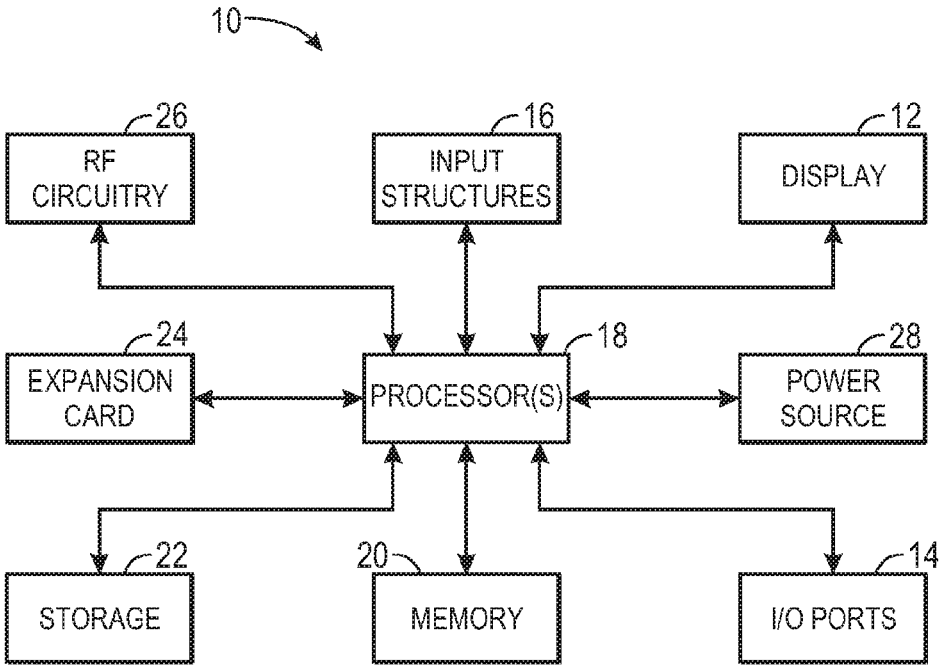
FIG. 1 is a simplified block diagram depicting components of an example of an electronic device having a display device that includes logic for controlling the slew rate of gate activation signals provided to pixels forming a viewable region of the display device, in accordance with aspects set forth in the present disclosure.

With the foregoing points in mind, FIG. 1 provides a block diagram illustrating an example of an electronic device 10 that may include logic configured to control the slew rate of gate activation signals sent to a display 12, such as a liquid crystal display (LCD), in accordance with aspects of the present disclosure. The electronic device 10 may be any type of electronic device, such as a laptop or desktop computer, a mobile phone, a digital media player, or the like, that includes the display 12. The various functional blocks depicted in FIG. 1 may include hardware elements (including circuitry), software elements (including computer code stored on computer-readable media, such as a hard drive or system memory), or a combination of both hardware and software elements. It should be noted that FIG. 1 is merely one example of a particular implementation and is merely intended to illustrate the types of components that may be present in the electronic device 10. For example, in the illustrated embodiment, these components may include the display 12 referenced above, as well as input/output (I/O) ports 14, input structures 16, one or more processors 18, memory device(s) 20, non-volatile storage 22, expansion card(s) 24, RF circuitry 26, and power source 28.

Before continuing, it should be understood that the system block diagram of the electronic device 10 shown in FIG. 1 is intended to represent a high-level control diagram. That is, the illustrated connective lines between each individual component shown in FIG. 1 may not necessarily represent paths or directions through which data flows or is transmitted between various components of the device 10, but is merely intended to show that the processor(s) 18 may interface and/or communicate either directly or indirectly with each component of the device 10.

The display 12 may be used to display various images generated by the electronic device 10. In the illustrated embodiment, the display 12 may be a liquid crystal display (LCD), such as an LCD that employs fringe-field switching (FFS), in-plane switching (IPS) or other techniques use in operating such LCD devices. The display 12 may be a color display utilizing a plurality of color channels for generating color images. By way of example, the display 12 may utilize a red, green, and blue color channel. As discussed further below, the display 12 in the form of an LCD may include a panel having an array of thin-film transistors (TFTs) representative of image pixels, and may also include slew rate control circuitry that is configured to select a desired slew rate for gate activation signals supplied to the TFTs to reduce the effects of voltage kickback (which may cause visual artifacts, such as flicker, to occur), and thus improve overall image quality. Further, in other embodiments, the display 12 may also be a display that uses plasma or organic light emitting diode (OLED) technologies. In one embodiment, the display may be a high-resolution LCD display having 300 or more pixels per inch, such as a Retina Display®, available from Apple Inc. Moreover, in some embodiments, the display 12 may be provided in conjunction with a touch-sensitive element, such as a touch screen, that may function as one of the input structures 16 for the electronic device 10. For instance, the touch screen may sense inputs based on contact with a user's finger or with a stylus.

The processor(s) 18 may control the general operation of the device 10. For instance, the processor(s) 18 may provide the processing capability to execute an operating system, programs, user and application interfaces, and any other functions of the electronic device 10. The processor(s) 18 may include one or more microprocessors, such as one or more "general-purpose" microprocessors, one or more special-purpose microprocessors and/or application-specific microprocessors (ASICs), or a combination of such processing components. For example, the processor(s) 18 may include one or more processors based upon x86 or RISC instruction set architectures, as well as dedicated graphics processors (GPU), image signal processors, video processors, audio processors and/or related chip sets. By way of example only, the processor(s) 18 may, in one embodiment, include a model of a system-on-a-chip (SoC) processor, such an A4 processor, available from Apple Inc. As will be appreciated, the processor(s) 18 may be coupled to one or more data buses for transferring data and instructions between various components of the device 10.

The instructions or data to be processed by the processor(s) 18 may be stored in a computer-readable medium, such as a memory device 20. The memory device 20 may be provided as volatile memory, such as random access memory (RAM), or as non-volatile memory, such as read-only memory (ROM), or as a combination of RAM and ROM devices. The memory 20 may store a variety of information and may be used for various purposes. For example, the memory 18 may store firmware for the device 10, such as a basic input/output system (BIOS), an operating system, various programs, applications, or any other routines that may be executed on the device 10, including user interface functions, processor functions, and so forth. The memory 20 may additionally be used for buffering or caching during operation of the device 10.

In addition to memory 20, the device 10 may further include a non-volatile storage 22 for persistent storage of data and/or instructions. The non-volatile storage 20 may include flash memory, a hard drive, or any other optical, magnetic, and/or solid-state storage media, or some combination thereof. Thus, although depicted as a single device in FIG. 1 for purposes of clarity, the non-volatile storage 22 may include a combination of one or more of such storage devices operating in conjunction with the processor(s) 18. The non-volatile storage 22 may be used to store firmware, data files, image data, software programs and applications, and any other suitable data. For instance, the non-volatile storage 22 may store image and/or video data that may be displayed and/or played back on the display device 12 for viewing by a user. Further, the RF circuitry 26 may enable the device 10 to connect to a network, such as a local area network, a wireless network (e.g., an 802.11x network or Bluetooth network), or a mobile network (EDGE, 3G, 4G, LTE, etc.), and to communicate with other devices over the network.

Figure 2:
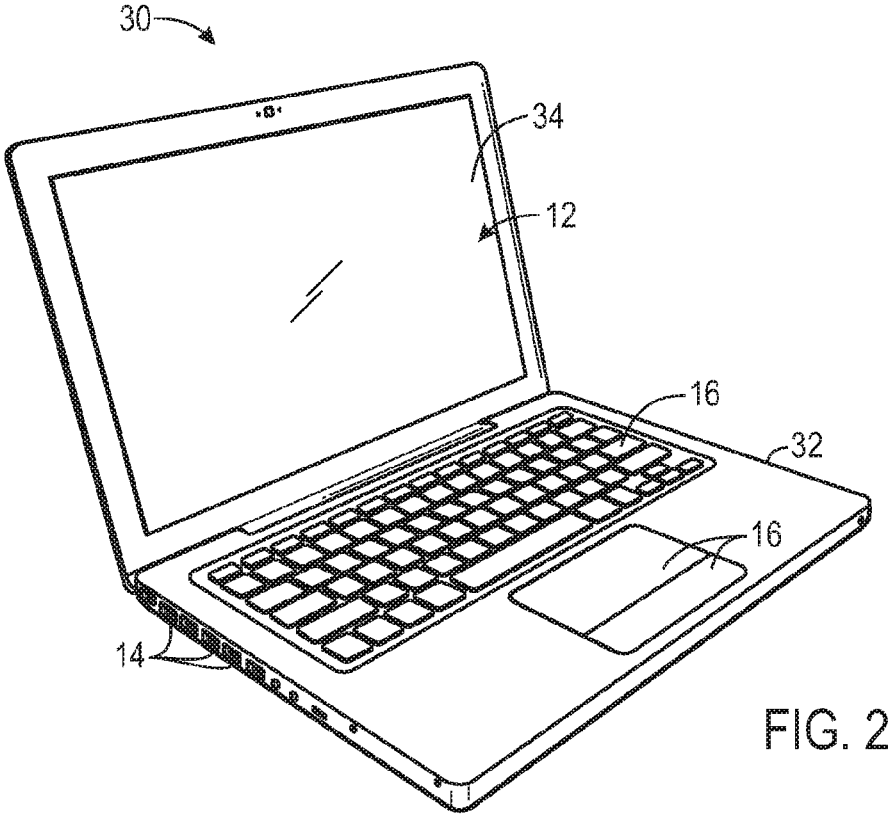
FIG. 2 shows the electronic device of FIG. 1 in the form of a computer.

FIG. 2 illustrates an embodiment of the electronic device 10 in the form of a computer 30. The computer 30 may include computers that are generally portable (such as laptop, notebook, tablet, and handheld computers), as well as computers that are generally used in one place (such as conventional desktop computers, workstations and/or servers). The depicted computer 30 includes a housing or enclosure 32, the display 12 (e.g., as an LCD 34 or other suitable display), I/O ports 14, and input structures 16. By way of example only, certain embodiments of the computer 30 may include a model of a MacBook®, MacBook Pro®, MacBook Air®, iMac®, Mac Mini®, or Mac Pro®, all available from Apple Inc.

The display 12 may be integrated with the computer 30 (e.g., the display of a laptop computer) or may be a standalone display that interfaces with the computer 30 through one of the I/O ports 14, such as via a DisplayPort, DVI, High-Definition Multimedia Interface (HDMI), or analog (D-sub) interface. For instance, in certain embodiments, such a standalone display 12 may be a model of an Apple Cinema Display®, available from Apple Inc. As will be discussed in further detail below, the display 12 in the form of the LCD 34 may include logic for controlling the slew rate of gate activation signals supplied to a TFT array of the LCD 34 in a manner that helps to reduce the occurrence of visual display artifacts, such as flicker, resulting from the effects of voltage kickback error, which may increase as the amount of channel charge distributed to a pixel electrode when a TFT is switched off by the gate activation signal increases.

Figure 3:
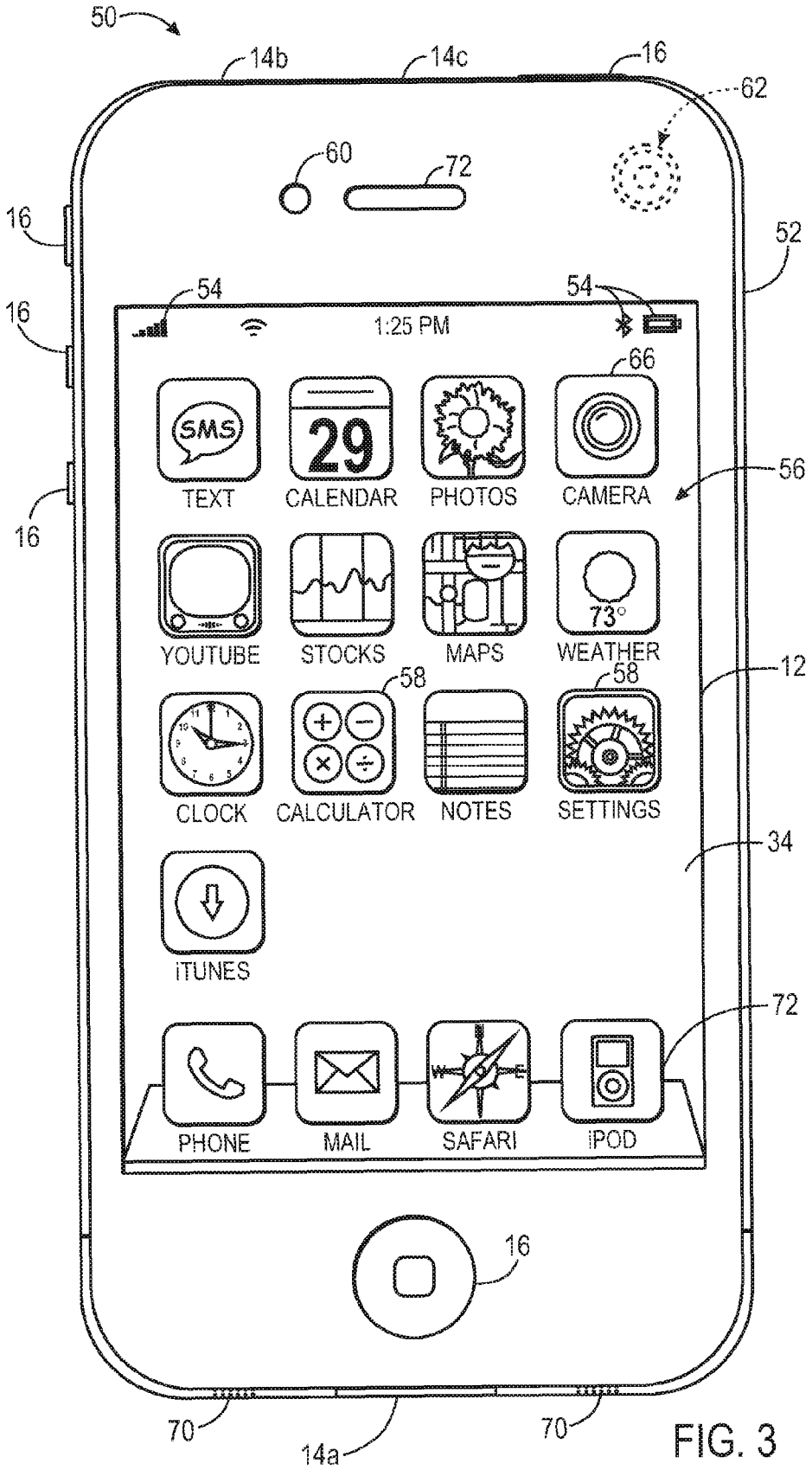
FIG. 3 is a front view of the electronic device of FIG. 1 in the form of a handheld portable electronic device.
Figure 4:
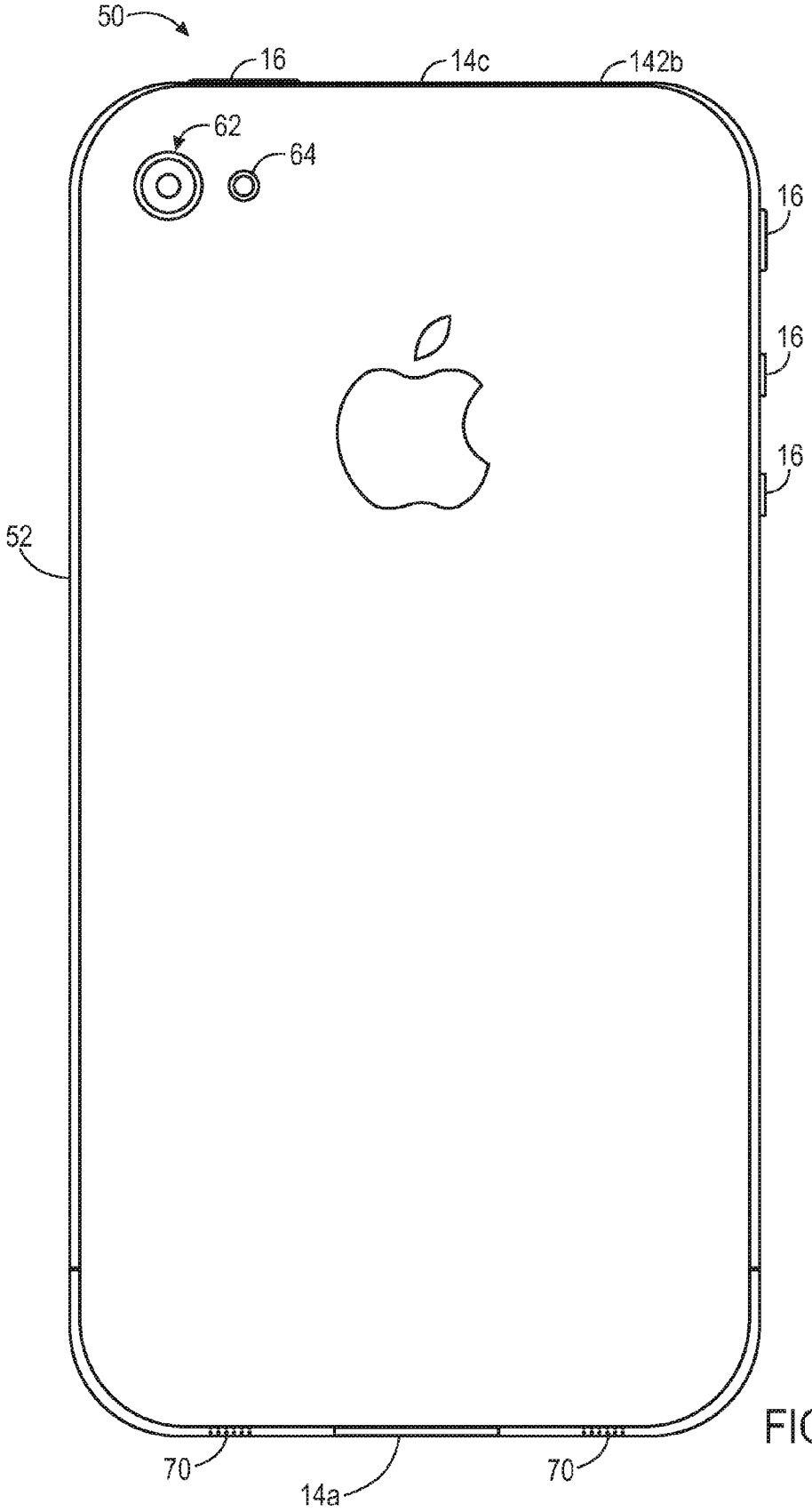
FIG. 4 is a rear view of the handheld electronic device shown in FIG. 3.

FIGS. 3 and 4 further depict the electronic device 10 in the form of a portable handheld electronic device 50, which may be a model of an iPod® or iPhone® available from Apple Inc. The handheld device 50 includes an enclosure 52, which may protect the interior components from physical damage and may also allow certain frequencies of electromagnetic radiation, such as wireless networking and/or telecommunication signals, to pass through to wireless communication circuitry (e.g., RF circuitry 26), which may be disposed within the enclosure 52. As shown, the enclosure 52 also includes various user input structures 16 through which a user may interface with the handheld device 50. For instance, each input structure 14 may be configured to control one or more device functions when pressed or actuated.

The device 50 also includes various I/O ports 14, which are depicted in FIG. 3 as a connection port 14*a* (e.g., a 30-pin dock-connector available from Apple Inc.) for transmitting and receiving data and for charging a power source 28, which may include one or more removable, rechargeable, and/or replaceable batteries. The I/O ports 14 may also include an audio connection port 14*b* for connecting the device 50 to an audio output device (e.g., headphones or speakers). Further, in embodiments where the handheld device 50 provides mobile phone functionality, the I/O port 14*c* may be provided for receiving a subscriber identify module (SIM) card (e.g., an expansion card 24).

The display 12, which may include the LCD panel 34, may display various images generated by the handheld device 50. For example, the display 12 may display system indicators 54 providing feedback to a user regarding one or more states of handheld device 50, such as power status, signal strength, and so forth. The display 12 may also display a graphical user interface (GUI) 56 that allows a user to interact with the device 50. In the presently illustrated embodiment, the displayed screen image of the GUI 56 may represent a home-screen of an operating system running on the device 50, which may be a version of the Mac OS® or iOS® (previously iPhone OS®) operating systems, both available from Apple Inc. The GUI 56 may include various graphical elements, such as icons 58, corresponding to various applications that may be executed upon user selection (e.g., receiving a user input corresponding to the selection of a particular icon 58).

The handheld device 50 additionally includes a front-facing camera 60 on the front side of the device 50 and a rear-facing camera 62 on the rear side of the device (shown in FIG. 4). In certain embodiments, one or more of the cameras 60 or 62 may be used in conjunction with a camera application 66 to acquire images for storage and viewing on the device 50. The rear side of the device 50 may also include flash module (sometimes referred to as a strobe), such as an LED, for illuminating an image scene captured using the camera 62, i.e., in low lighting conditions. The front and rear facing cameras 60 and 62 may also be utilized to provide video-conferencing capabilities, such as via use of a video-conferencing application based upon FaceTime®, available from Apple Inc. Additionally, the handheld device 50 may include various audio input and output elements 70 and 72. In embodiments where the handheld device 50 includes mobile phone functionality, the audio input/output elements 70 and 72 may collectively function as the audio receiving and transmitting elements of a telephone.

Figure 5:
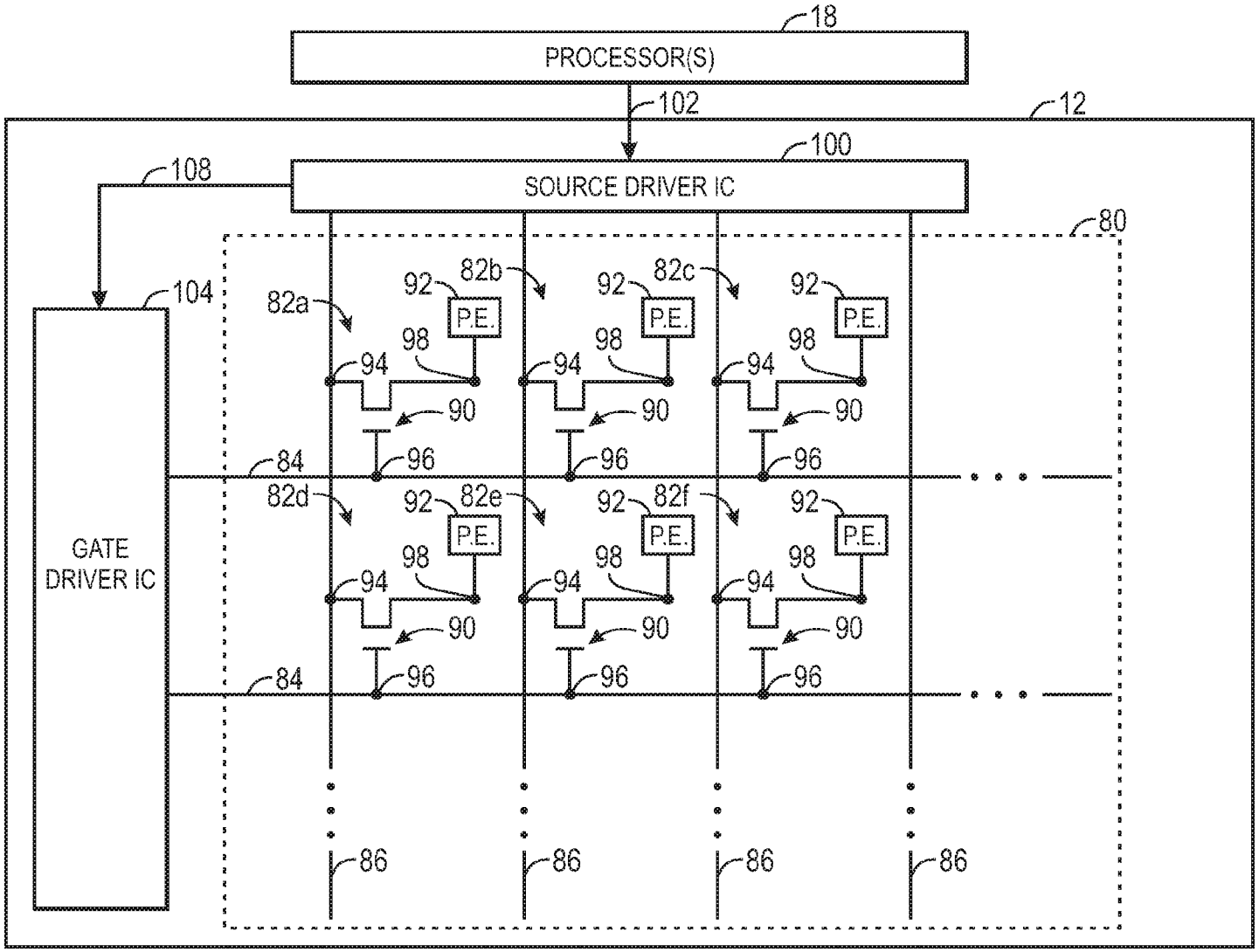
FIG. 5 is a circuit diagram illustrating a portion of an array of unit pixels of the display device of FIG. 1 that may be controlled to store image data using source driving circuitry and gate driving circuitry provided by the display device, in accordance with aspects of the present disclosure.

Referring to FIG. 5 a circuit diagram of the display 12 is illustrated, in accordance with an embodiment. As shown, the display 12 may include a display panel 80, such as a liquid crystal display panel. The display panel 80 may include multiple unit pixels 82 arranged as an array or matrix defining multiple rows and columns of unit pixels 82 that collectively form an image viewable region of the display 12. In such an array, each unit pixel 82 may be defined by the intersection of rows and columns, represented here by the illustrated gate lines 84 (also referred to as "scanning lines") and source lines 86 (also referred to as "data lines"), respectively.

Although only six unit pixels, referred to individually by the reference numbers 82*a*-82*f*, respectively, are shown for purposes of simplicity, it should be understood that in an actual implementation, each source line 86 and gate line 84 may include hundreds or even thousands of such unit pixels 82. By way of example, in a color display panel 80 having a display resolution of 1024×768, each source line 86, which may define a column of the pixel array, may include 768 unit pixels, while each gate line 84, which may define a row of the pixel array, may include 1024 groups of unit pixels with each group including a red, blue, and green pixel, thus totaling 3072 unit pixels per gate line 84. By way of further example, the panel 80 may have a display resolution of 480×320 or, alternatively, 960×640. As will be appreciated, in the context of LCDs, the color of a particular unit pixel generally depends on a particular color filter that is disposed over a liquid crystal layer of the unit pixel. In the presently illustrated example, the group of unit pixels 82*a*-82*c* may represent a group of pixels having a red pixel (82*a*), a blue pixel (82*b*), and a green pixel (82*c*). The group of unit pixels 82*d*-82*f* may be arranged in a similar manner.

Each unit pixel 82*a*-82*f* shown in FIG. 5 includes a thin film transistor (TFT) 90 for switching a respective pixel electrode 92. In the depicted embodiment, the source 94 of each TFT 90 may be electrically connected to a source line 86. Similarly, the gate 96 of each TFT 90 may be electrically connected to a gate line 84. Furthermore, the drain 98 of each TFT 90 may be electrically connected to a respective pixel electrode 92. Each TFT 90 serves as a switching element and may be activated and deactivated (e.g., turned on and off) for a predetermined period based upon the respective presence or absence of a gate activation signal (e.g., also referred to as a scanning signal or gate clock signal) at the gate 96 of the TFT 90. For instance, when activated, the TFT 90 may store the image signals received via a respective source line 86 as a charge in its corresponding pixel electrode 92. The image signals stored by pixel electrode 92 may be used to generate an electrical field between the respective pixel electrode 92 and a common electrode (not shown in FIG. 5), which may collectively form a liquid crystal capacitor for a given unit pixel 82. Thus, in an LCD panel 80, such an electrical field may align liquid crystals molecules within a liquid crystal layer to modulate light transmission through a region of the liquid crystal layer corresponding to the unit pixel 82. For instance, light is typically transmitted through the unit pixel 82 at an intensity corresponding to the applied voltage (e.g., from a corresponding source line 86).

The display 12 also includes a source driver integrated circuit (IC) 100, which may include a chip, such as a processor or ASIC, that is configured to control various aspects of display 12 and panel 80. For example, the source driver IC 100 may receive image data 102 from the processor(s) 18 and send corresponding image signals to the unit pixels 82 of the panel 80. The source driver IC 100 may also be coupled to a gate driver IC 104, which may be configured to provide/remove gate activation signals to activate/deactivate rows of unit pixels 82 via the gate lines 84. As used herein, the "removal" of a gate activation signal is intended to refer to a transitioning of the gate activation signal to a state that causes the TFT to which it is applied to switch off. As can be appreciated, depending on the type of TFT used, a logic high state of the gate activation signal (active-high TFTs) or logic low state (active-low TFTs) may cause the TFT to switch on.

The source driver IC 100 may include a timing controller that determines and sends timing information, represented here as 108, to the gate driver IC 104 to facilitate activation and deactivation of individual rows of pixels 82. In other embodiments, timing information may be provided to the gate driver IC 104 in some other manner (e.g., using a timing controller that is separate from the source driver IC 100). Further, while FIG. 5 depicts only a single source driver IC 100, it should be appreciated that additional embodiments may utilize multiple source driver ICs 100 in providing image signals to the pixels 82 of the panel 80. For example, additional embodiments may include multiple source driver ICs 100 disposed along one or more edges of the panel 80, wherein each source driver IC 100 is configured to control a subset of the source lines 86 and/or gate lines 84.

In operation, the source driver IC 100 receives image data 102 from the processor 18 or a discrete display controller and, based on the received data, outputs signals to control the pixels 82. For instance, to display image data 102, the source driver IC 100 may adjust the voltage of the pixel electrodes 92 (abbreviated in FIG. 5 as P.E.) one row at a time. To access an individual row of pixels 82, the gate driver IC 104 may assert a gate activation signal (e.g., setting the signal to a state that switches the TFT on) to the TFTs 90 associated with the particular row of pixels 82 being addressed. This activation signal may render the TFTs 90 on the addressed row conductive, and image data 102 corresponding to the addressed row may be transmitted from source driver IC 100 to each of the unit pixels 82 within the addressed row via respective data lines 86. Thereafter, the gate driver IC 104 may deactivate the TFTs 90 in the addressed row by de-asserting the gate activation signal (e.g., setting the signal to a state that switches the TFT off), thereby impeding the pixels 82 within that row from changing state until the next time they are addressed. The above-described process may be repeated for each row of pixels 82 in the panel 80 to reproduce image data 102 as a viewable image on the display 12.

As discussed above, a problem that may contribute to the manifestation of visual artifacts in certain conventional LCD displays relates to the slew rate of a gate activation signal and the channel charge distribution of TFTs in an addressed row. Namely, charge that remains in the channel of a TFT when it is switched off is distributed between the pixel electrode and source line corresponding to the TFT in a manner that is dependent upon the slew rate of the gate activation signal. This is shown in more detail in FIGS. 6 and 7 below. While the examples below describe the TFT 90 as operating as an active-high transistor, it should be appreciated that other embodiments may also utilize active-low transistors for the TFTs 90.

Figure 6:
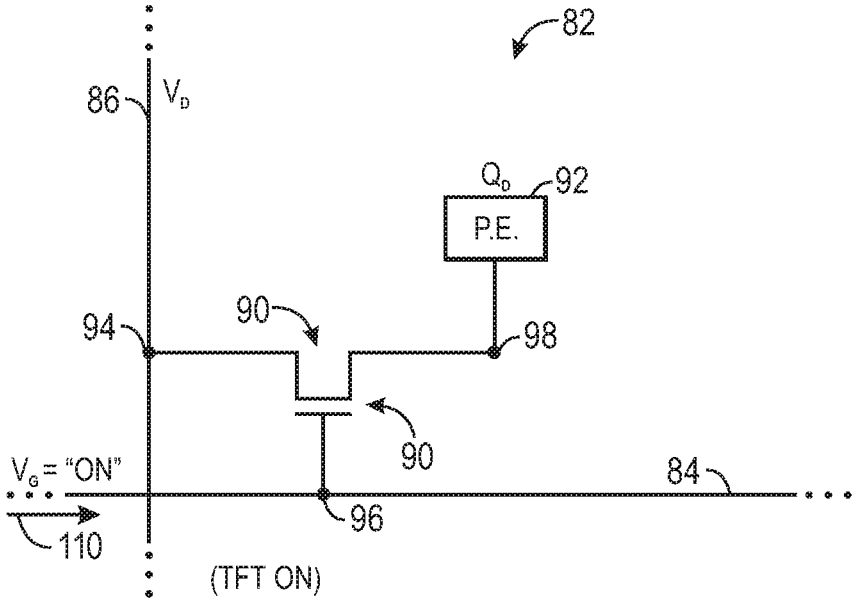
FIGS. 6 and 7 depict channel charge behavior of a thin-film-transistor (TFT) of an individual unit pixel when it is switched from an on state to an off state, in accordance with aspects of the present disclosure.

Particularly, FIG. 6 depicts a pixel 82 of the panel 80 with its TFT 90 switched on. This is represented by a gate activation signal 110 having a voltage $V_G$ sufficient to switch the TFT 90 on. By way of example, the value of $V_G$ may be at least equal to or greater than a threshold voltage of the TFT 90. When the TFT 90 is switched on, a conductive path is formed between the source line 86 and the pixel electrode 92. Accordingly, a data voltage $V_D$ provided to the source line 86 and corresponding to image data may be stored in the pixel electrode 92 as a charge $Q_D$ representative of the data voltage $V_D$.

Figure 7:
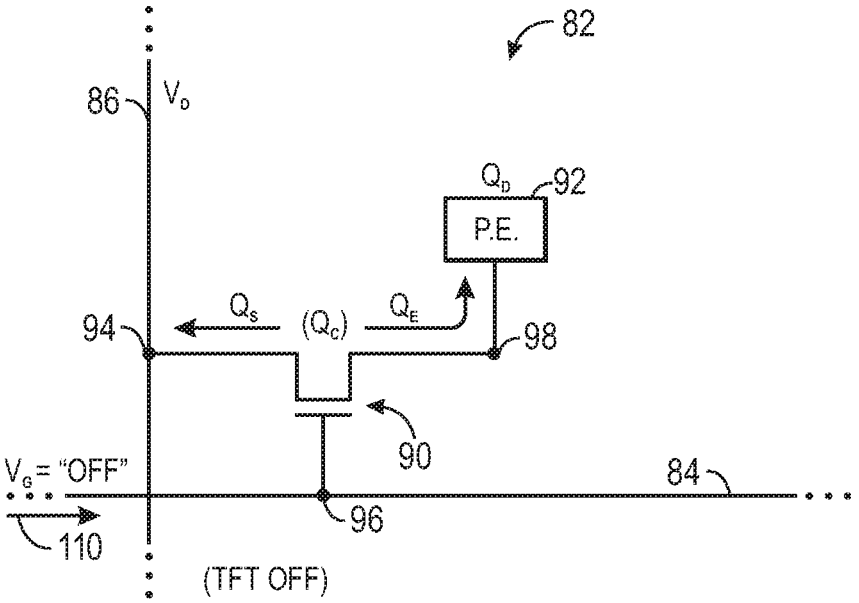

Next, FIG. 7 depicts the same pixel 82 from FIG. 6 as the TFT 90 is being switched off. For instance, the gate activation signal 110 may be de-asserted, such that the voltage $V_G$ is removed or reduced to a level that is no longer sufficient to maintain the TFT 90 in the on state. As discussed above, as the TFT 90 is switched off, charge remaining within the channel of the TFT 90, represented here as $Q_C$, is distributed to the source line 86 and pixel electrode 92 as the charges $Q_S$ and $Q_E$, respectively, where $Q_E$ represents an error charge. As the slew rate of the gate activation signal 110 increases, the amount charge $Q_E$ that is distributed to the pixel electrode 92 also generally increases. Thus, gate activation signals 110 with faster slew rates may cause more error charge $Q_E$ to be distributed to the pixel electrode 92. Due to effects related to voltage kickback, gate activation signals 110 having relatively fast slew rates may sometimes undesirably cause the display 12 to experience certain visual artifacts, such as flicker. By way of example, in an embodiment where the total charge stored in the pixel electrode 92 is proportional to the amount of light that is emitted from the pixel 82, the addition of the error charge $Q_E$ to the charge $Q_D$ corresponding to the data voltage $V_D$ from FIG. 6 may result greater amount of light being transmitted through the pixel 82 than is expected based on the data voltage $V_D$. When this effect occurs across a sufficient number of pixels 82 in the display panel 80, a viewer may perceive the net result as flicker.

Figure 8:
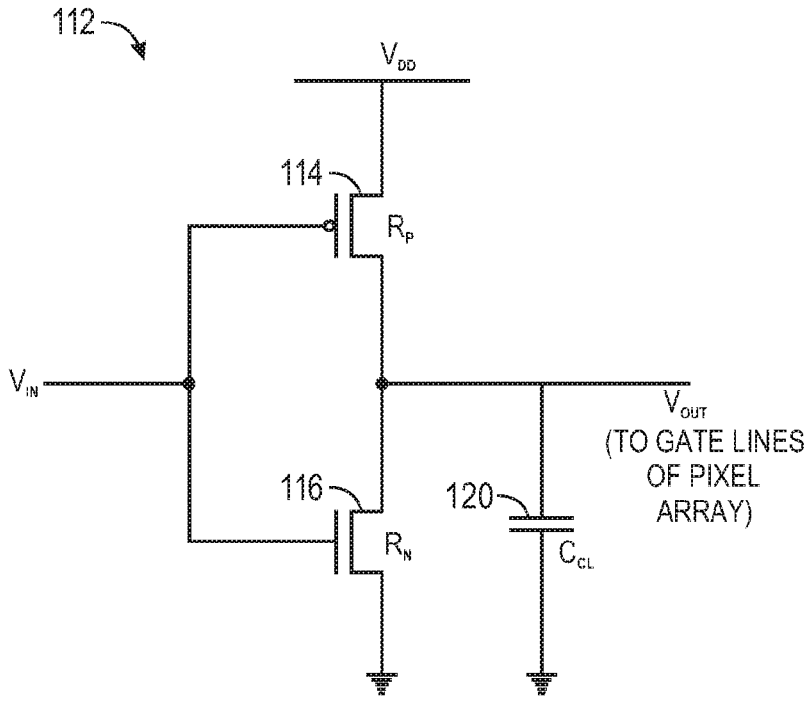
FIG. 8 shows a conventional output buffer circuit that may be used to generate a gate activation signal.

As can be appreciated, the slew rate of the gate activation signal may be dependent upon the output circuitry of the gate driver IC. For instance, some conventional gate driver circuits may utilize an output buffer for driving gate activation signals to the gate lines of a display panel. To provide some context and background for the present techniques related to slew rate control that are described further below, FIG. 8 illustrates an example of one type of conventional output buffer 112 that may used in conventional gate driving circuitry. The output buffer 112 may be configured as a binary CMOS buffer and includes an input $V_{IN}$, a p-type (PMOS) transistor 114, an n-type (NMOS) transistor 116, and capacitor 120. As shown, the p-type transistor 114 may have a resistance $R_P$ and the n-type transistor 116 may have a resistance $R_N$. The output buffer 112 may receive the input $V_{IN}$ and produce the output signal $V_{OUT}$, which may represent a gate activation signal that is driven to a pixel array of an LCD panel to switch on the TFTs of a selected row. For instance, the generation of the signal $V_{OUT}$ may correspond to the charging and discharging of the capacitor 120 as the input signal $V_{IN}$ transitions between logically low and high states, and the input signal $V_{IN}$ may be a clock signal provided to the gate driver circuitry for timing the activation/deactivation of gate lines in the display panel.

Figure 9:
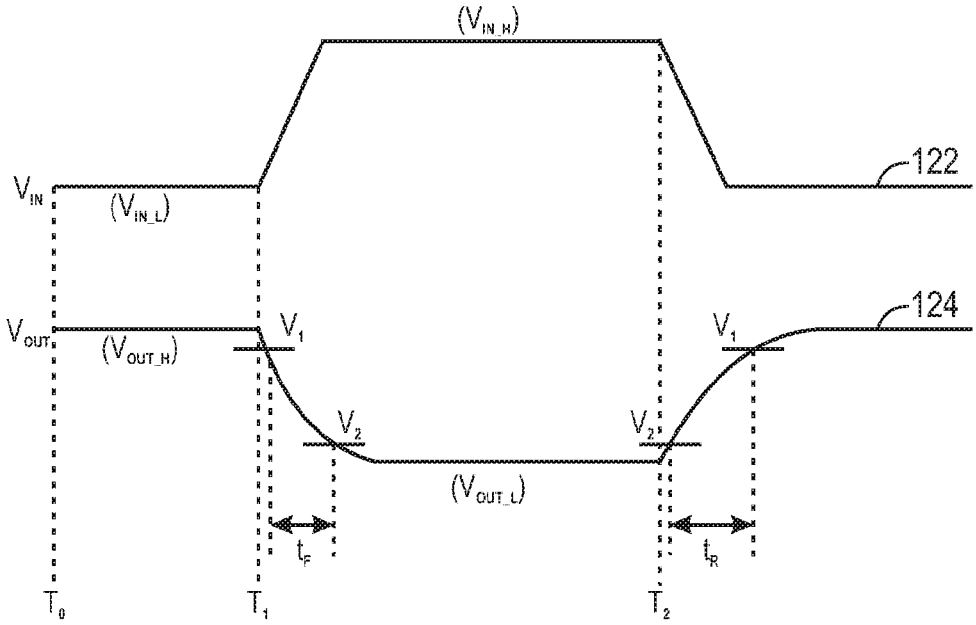
FIG. 9 is a timing diagram showing the slew rate of the rising and falling edges of pulses in a gate activation signal.

FIG. 9 illustrates how the output signal $V_{OUT}$ (represented by line 124), which represents the gate activation signal, may transition in response to the input signal $V_{IN}$ (represented by line 122). As shown, in the interval from time T0 to time T1, $V_{IN}$ is in a logically low state ($V_{IN_L}$) and $V_{OUT}$ is in a logically high state ($V_{OUT_H}$). Then, from times T1 to T2, $V_{IN}$ transitions to a logically high state ($V_{IN_H}$), which causes the signal $V_{OUT}$ to transition to a logically low state ($V_{OUT_L}$). Thus, assuming an LCD panel that is made up of active-high TFTs, the time T1 may correspond to the switching off of the TFTs of a currently selected row. However, as shown, the transition from $V_{OUT_H}$ to $V_{OUT_L}$ is not instantaneous, but rather occurs over a period of time. As commonly recognized in the art, when referring to slew rates, a transition time may sometimes be defined as the time required for an output signal to transition from 10 percent and 90 percent in response to a step or change in an input signal, and is usually expressed in units of volts per unit of time (e.g., millisecond, microsecond, etc.). Thus, in the present example, $V_1$ and $V_2$ may represent voltages that are 90 percent and 10 percent of $V_{OUT_H}$, respectively. Accordingly, the slew rate for the falling edge of $V_{OUT}$ (e.g., transition from V-$_{OUT_H}$ to $V_{OUT_L}$) may correspond to the time represented by interval $t_F$. Similarly, at time T2, V-$_{IN}$ transitions back to the logically low state ($V_{IN_L}$), which causes the signal $V_{OUT}$ to transition to back to the logically high state ($V_{OUT_H}$). Here, the slew rate for the rising edge of $V_{OUT}$ (e.g., transition from $V_{OUT_L}$ to $V_{OUT_H}$) may correspond to the time represented by interval $t_R$. As can be appreciated, each pulse of the signal $V_{OUT}$ may represent the activation of a row of TFTs within the panel 80. Thus, to display a frame of image data, each row of TFTs may be activated and deactivated consecutively in a sequential manner.

Referring still to FIGS. 8 and 9, the rise and fall slew rates of signal $V_{OUT}$ corresponding to the rise and fall intervals $t_R$ and $t_F$, respectively, may be determined as a function of the RC time constants ($\tau$) of the binary CMOS output buffer circuit 112. As can be appreciated, the RC time constants may correspond to the resistance and capacitance values of the circuit 112. For example, the falling edge slew rate of $V_{OUT}$ (over interval $t_F$) may be a function of the time constant $\tau_F$, and the rising edge slew rate of $V_{OUT}$ (over interval $t_R$) may be a function of the time constant $\tau_R$, wherein $\tau_F$ and $\tau_R$ are expressed by the following:

$$\tau_F = R_N \times C_L \quad (1)$$

$$\tau_R = R_P \times C_L \quad (2)$$

As such, in the circuit 112 of FIG. 8, the rise and fall slew rates shown in FIG. 9 may be increased or decreased by varying these time constant values.

In one type of conventional binary CMOS output buffer circuit, the capability to adjust the values for $R_N$ and $R_P$ may be provided by replacing the single PMOS transistor 114 shown in FIG. 8 with a bank of multiple identical transistors 114 arranged in parallel, each having its respective gate connected to $V_{IN}$ and each having the same impedance, and by replacing the single NMOS transistor 116 shown in FIG. 8 with a bank of multiple identical transistors 116 arranged in parallel, each having its respective gate connected to $V_{IN}$ and each having the same impedance. Each of the transistor banks may further be configured to allow for selection of all or a subset of the transistors 114, 116 during operation. For instance, a control signal may determine how many NMOS or PMOS transistors contribute to the overall resistance $R_N$ of the NMOS transistor bank and the overall resistance $R_P$ of the PMOS transistor bank. For example, when only a subset of the transistors within a bank are selected, $R_P$ may be decreased by selecting additional PMOS transistors, thus lowering the parallel equivalent resistance of the PMOS transistor bank, and increased by deselecting PMOS transistors, thus increasing the parallel equivalent resistance of the PMOS transistor bank. The resistance $R_N$ may be adjusted by selecting or deselecting transistors of the NMOS transistor bank in a similar manner.

Thus, by varying $R_P$ and $R_N$, the slew rate of the signal $V_{OUT}$ produced by the conventional output buffer 112 may be adjusted. Although the method described with respect to output buffer 112 of FIG. 8 does offer some degree of control over the slew rate of the output signal $V_{OUT}$, it will be appreciated that $R_P$ and $R_N$ may to subject to variations due to operating conditions, such as process, voltage, and/or temperature variations. Thus, adjustment of time constants ($\tau_F$ and $\tau_R$) alone may not be sufficient to achieve a desired slew rate under all operating conditions. Additionally, the need for the parallel arrangement of multiple transistors increases circuit real estate area, and may increase overall component and/or manufacturing costs.

Figure 10:
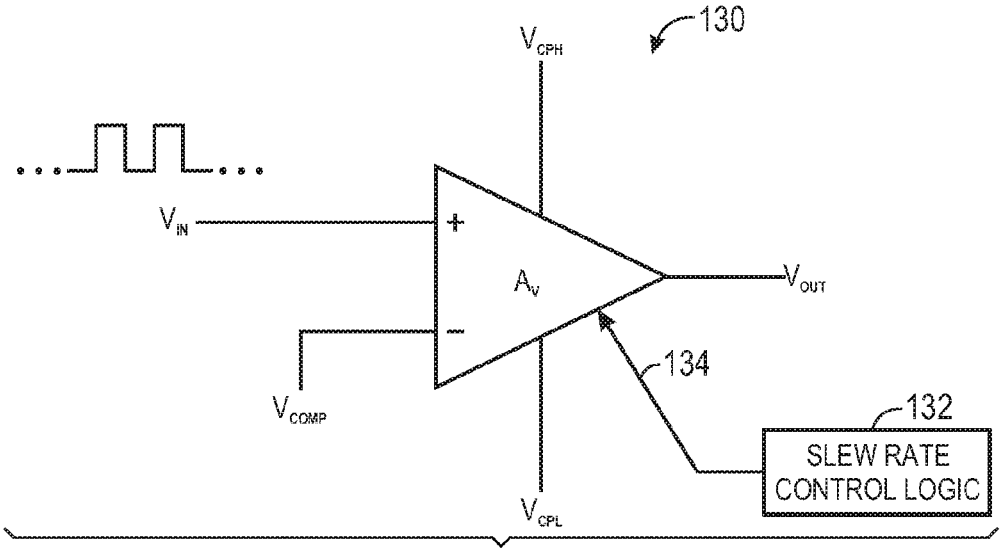
FIG. 10 shows an operational amplifier and slew rate control logic that may be utilized in a gate driver circuit to produce an output signal having a slew rate that may be adjusted independently of R and C time constants, in accordance with an embodiment of the present disclosure.

As discussed above, embodiments of the present disclosure may address one or more of the above-mentioned drawbacks by providing techniques for controlling the slew rate of a gate activation signal, which may be based upon a clock signal provided to the gate driver IC 104 (FIG. 5), independent of RC time constants. With reference to FIG. 10, one embodiment of the present disclosure may utilize a rail-to-rail operation amplifier (op-amp) 130 as an output circuit for the gate clock signal (represented here by $V_{OUT}$) that is driven to the gate lines to switch the TFTs 90 of the LCD panel 80. As shown, the schematically illustrated op-amp 130 includes the differential inputs $V_{IN}$ and $V_{COMP}$ and may be connected to the supply rails VCPH and VCPL. As can be appreciated, VCPH (clock pulse high) and VCPL (clock pulse low) may represent the voltages corresponding to the high and low states, respectively, of a gate clocking signal, represented here by $V_{OUT}$, supplied to the panel 80. As discussed in more detail below in FIG. 11, the rail-to-rail op-amp 130, which has a gain $A_V$, may operate in conjunction with a slew rate control circuit 132, which may provide one or more control signals 134 for adjusting the slew rate of $V_{OUT}$. Particularly, in contrast to conventional slew rate control solutions, such as those described with respect to FIGS. 8 and 9 above, control of the slew rate for $V_{OUT}$ using the embodiment shown in FIG. 10 may be accomplished without the need to modify or adjust R or C time constant variables.

Figure 11:
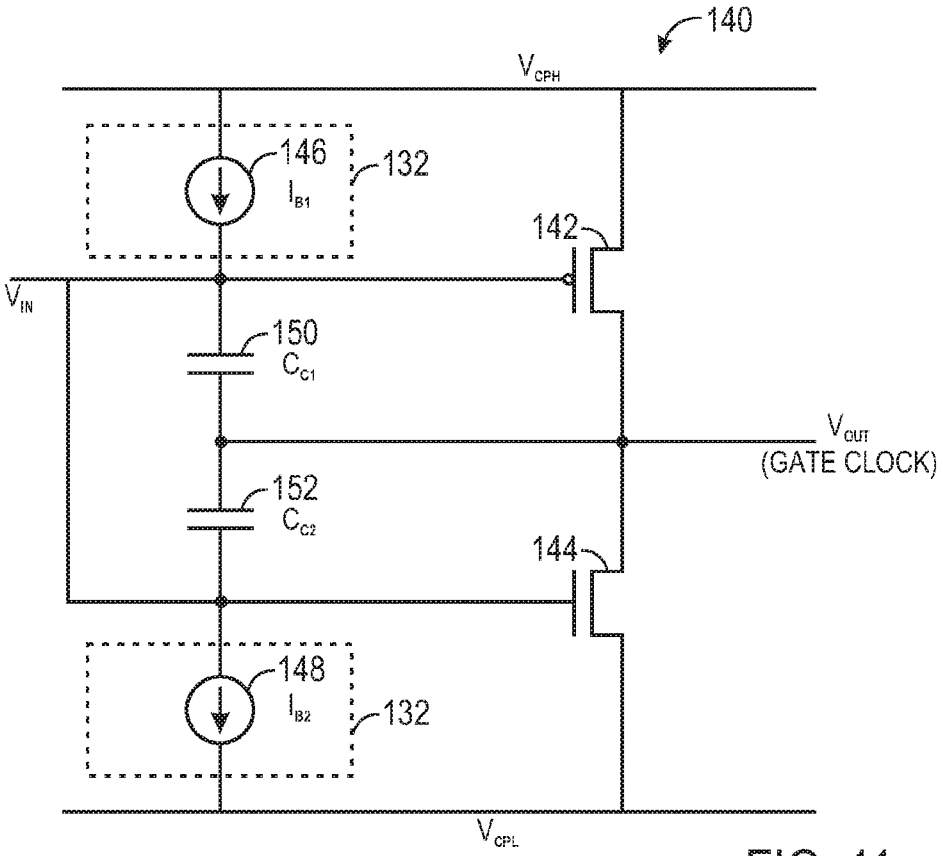
FIG. 11 is a circuit diagram illustrating an output stage of the operational amplifier of FIG. 10, in accordance with an embodiment of the present disclosure.

FIG. 11 is a circuit diagram that may represent an output stage 140 of rail-to-rail input/output op-amp 130 symbolically shown in FIG. 10. The output stage 140 includes the PMOS transistor 142, NMOS transistor 144, current sources 146 and 148 (providing bias currents $I_{B1}$ and $I_{B2}$, respectively), and capacitors 150 and 152 ($C_{C1}$ and $C_{C2}$). In operation, the output stage 140 provides the signal $V_{IN}$ to the transistors 142 and 144, and the clock pulses for the gate activation signal ($V_{OUT}$) are generated based on the state of $V_{IN}$. For instance, in the present embodiment, when $V_{IN}$ is in a logic low state, the NMOS transistor 144 will be in an off state and the PMOS transistor 142 will be in an on state, causing the output gate signal $V_{OUT}$ to have a high state corresponding to the supply rail VCPH that is sufficient to switch on a first selected row of pixels in the LCD panel 80. When $V_{IN}$ transitions to a logic high state, the PMOS transistor 142 switches off and the NMOS transistor 144 switches on, which causes the gate signal $V_{OUT}$ to transition from the high state (VCPH) to a low state corresponding to the supply rail VCPL, which may deactivate the TFTs 90 of the first selected row. When $V_{IN}$ transitions back to the logic low state, the gate signal $V_{OUT}$ will transition back to a high state (VCPH), and may activate a second selected row of pixels in the panel 80 (e.g., a row adjacent to the first selected row of pixels), and so forth. While the transistors 142 and 144 are described herein as being MOSFET transistors, any type of field effect transistors may be utilized, such as JFETS, or nFETs (negative channel field effect transistors).

Referring back to the discussion above of FIGS. 6 and 7, the slew rate of the signal $V_{OUT}$ (e.g., the speed at which is transitions states) may affect the amount of error charge $Q_E$ that is distributed to the pixel electrodes of the TFTs 90 of the selected row. In the present embodiment, control the slew rate of the signal $V_{OUT}$ may be achieved by controlling the current ($I_{B1}$ and IB2) provided by the current sources 146 and 148, which may be part of the slew rate control logic 132. This process is described below.

As shown in FIG. 11, the output stage 140 includes the capacitors $C_{C1}$ and $C_{C2}$, which may be compensation capacitances, coupled between the gates of the transistors 142 and 144 and their respective outputs. Thus, using capacitor $C_{C1}$ as an example, the effective capacitance provided by the op-amp, as seen from the input side, may be determined in accordance with the Miller effect by multiplying the input capacitance $C_{C1}$ by the gain ($A_V$) of the op-amp 130. Thus, the effective capacitance may be expressed as follows:

$$C_{eff}=A_V\times C_{C1} \tag{3}$$

By way of example only, assuming a gain $A_V$ of 10,000 ($10^4$) and a compensation capacitance $C_{C1}$ of 5 picofarads (pf), the effective capacitance $C_{eff}$ may be equal to 50 nanofarads.

Further, using the effective capacitance, the slew rate of $V_{OUT}$ may, in the present embodiment, be determined based on the following equation:

$$SR=\frac{I_{B1}}{A_V\times C_{C1}}, \tag{4}$$

wherein SR represents the slew rate, $I_{B1}$ represents the current produced by the current source 146, and $A_VC_{C1}$ is the effective capacitance ($C_{eff}$). Thus, since the gain ($A_V$) of the op-amp 130 and the capacitance $C_{C1}$ will generally remain constant, the slew rate may be increased or decreased by adjusting the current $I_{B1}$. For instance, increasing $I_{B1}$ may increase the slew rate (SR) of the rising edge transition of $V_{OUT}$, thus decreasing the time required to transition from logic low (VCPL) to logic high states (VCPH). Similarly, a decrease in $I_{B1}$ may decrease the slew rate of the rising edge transition of $V_{OUT}$, which may increase the time required to transition from logic low to logic high states. As can be appreciated, the slew rate for the falling edge transition of $V_{OUT}$ in the present embodiment may be determined similarly to Equation 4, but as a function of $I_{B2}$ and $A_VC_{C2}$. For instance, the slew rate of the falling edge transition of $V_{OUT}$ may be increased or decreased by adjusting $I_{B2}$.

Accordingly, by adjusting the current provided by the current sources $I_{B1}$ and $I_{B2}$, the slew rate of the output signal $V_{OUT}$ produced by the output stage 140 of the op-amp 130 can be controlled without having to vary R or C time constant parameters. In one embodiment, $I_{B1}$ and $I_{B2}$ may be controlled such that the rise and fall times for the gate clocking signal ($V_{OUT}$) are symmetrical, i.e., the signal takes approximately the same amount of time to transition from high to low as from low to high. Thus, using the techniques described here with respect to FIGS. 10 and 11, the slew rate of the gate clocking signal ($V_{OUT}$) may be controlled in a manner that is favorable to counter the occurrence of artifacts due to effects of voltage kickback. As can be appreciated, a suitable slew rate may vary among different types of displays and may depend on various factors, such as transistor (TFT) design and characteristics. Accordingly, an ideal slew rate for a given display may be determined through empirical testing.

Figure 12:
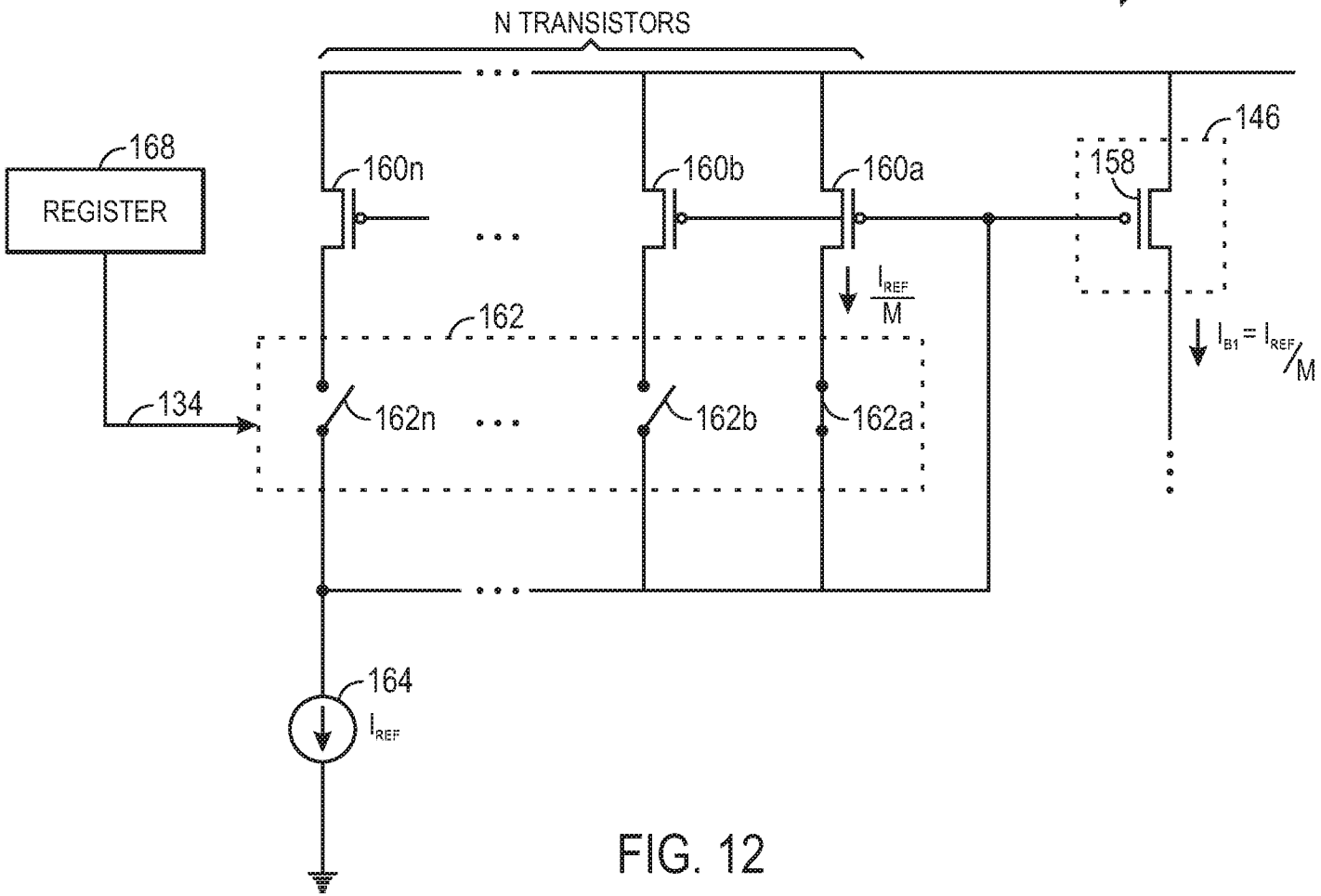
FIG. 12 depicts a current mirror circuit that may be provided as part of the slew rate control logic of FIG. 10 and configured to vary a bias current of the output stage of FIG. 11 to adjust the slew rate of the output signal, in accordance with an embodiment of the present disclosure.

Referring now to FIG. 12, a circuit diagram showing an embodiment of a control circuit 132 configured to adjust or program the bias current $I_{B1}$ and, therefore, adjust the slew rate of $V_{OUT}$, is illustrated. As shown in this embodiment, the circuit 132 includes the transistor 158 that is part of the current source 146 and a bank of "N" transistors 160*a*-160*n* arranged in parallel. The transistors 160*a*-160*n* and the transistor 158 may all be identical with equal impedances, with the gate of the transistor 158 being coupled to the gates of each of the transistors 160*a*-160*n*, as shown in FIG. 12. Further, while the present embodiment shows p-type transistors, it will be appreciated that n-type transistors may also be used in accordance with the present technique.

The control circuit 132 of the present embodiment is essentially configured as a current mirroring circuit, such that the current $I_{B1}$ is determined based on the current passing through the transistors 160. For instance, as shown, the circuit 132 includes a set of switching devices 162*a*-162*n* corresponding to transistors 160*a*-160*n*, respectively, and a current source 164 that provides a reference current $I_{REF}$. Each of the switching devices 162*a*-162*n* may be in a closed state or an open state depending on a provided control signal 134 (FIG. 10). For instance, the control signal 134 may actually represent a set of multiple control signals each corresponding to a respective one of the switches 162*a*-162*n*. For example, in the illustrated embodiment, an N-bit control register 168 may be programmed to control the states of the switches 162, wherein the state of each bit in the register 168 determines the state of is respective corresponding switch 162. Thus, as can be appreciated, the switches 162*a*-162*n* may be utilized to select a number (M) of transistors 160*a*-160*n*, which may be N if all transistors are selected, or a value between 1 and N−1 if only a subset of the transistors 160*a*-160*n* is selected. For instance, assuming only the switch 162*a* (corresponding to transistor 160*a*) is closed with all other switches 162*b*-162*n* being open, then the current through the transistor 160*a* will be equal to $I_{REF}$, as the open legs caused by the remaining open switches 162*b*-162*n* will result in open circuits with no current flowing through the remaining transistors 160*b*-160*n*. If switches 162*a* and 162*b* are closed, then a current equal to $I_{REF}/2$ will flow through each of the transistors 160*a* and 160*b*.

Thus, the transistors 160*a*-160*n* essentially function as a current divider, wherein the current flowing through the M selected transistors (e.g., selected based on control signal 134) is equal to $I_{REF}/M$, wherein M is the number of selected transistors 160 (e.g., those with corresponding switches 162 closed). Accordingly, because the control circuit 132 is configured as a current mirror, the current $I_{B1}$ output of the current source 146 (e.g., current flowing through transistor 158) will be equivalent to $I_{REF}/M$. Thus, $I_{B1}$ may be increased by selecting fewer transistors 160, or decreased by selecting more transistors. As discussed above, since the relationship between falling and rising transition time and $I_{B1}$ is inversely proportional, increasing $I_{B1}$ will increase slew rate, thus decreasing transition time, and decreasing $I_{B1}$ will decrease slew rate, thus increasing transition time. Utilizing the current programming circuit 132, the present technique may provide a relatively easy way to control the slew rate of the output signal $V_{OUT}$ independently of R and C time constants.

Further, while the present example only illustrates the control of the current $I_{B1}$ produced by the current source 146, it shall be appreciated that the current $I_{B2}$ produced by the current source 148 may be controlled using similar circuitry. Thus, in some embodiments, the control circuitry 132 may include a first current mirroring circuit coupled to the current source 146 and a second current mirroring circuit coupled to the current source 148.

Figure 13:
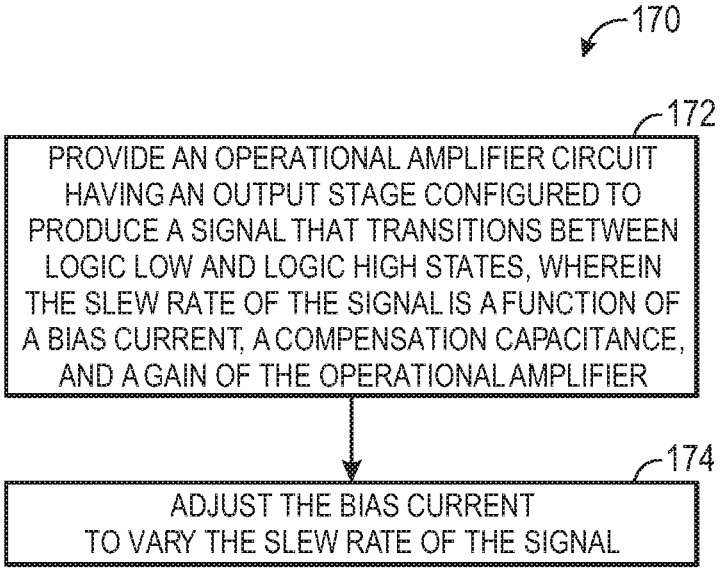
FIG. 13 is a flow chart depicting an example of a process for controlling slew rate in accordance with aspects the present disclosure.

The techniques discussed above may be further illustrated by way of the flow chart shown in FIG. 13, which represents a process 170 for controlling slew rate. The process 170 includes initially a step (block 172) of providing an op-amp circuit having an output stage configured to produce a pulsing signal (e.g., one that repeatedly transitions between two different logic states), wherein the slew rate of the signal is a function of a bias current (e.g., $I_{B1}$), a gain of the op-amp (e.g., $A_v$), and a compensation capacitance (e.g., $C_{C1}$ coupled between a gate and output of an output transistor of the output stage). By way of example, the pulsing signal may be a gate activation or clocking signal for driving gate lines of an array of TFTs in an LCD panel. Next, the slew rate of the signal maybe adjusted (block 174) by adjusting the bias current (e.g., $I_{B1}$). For instance, as discussed above with reference to FIG. 12, the bias current may be adjusted using a current mirroring circuit. In this manner, the slew rate of the signal produced by the output stage may be adjusted without needing to vary R or C time constants.

Further, as discussed above, the present techniques may be used in one application for adjusting the slew rate at the falling edge of a gate clocking signal for an LCD panel, such that excess channel charge remaining in the channel of a TFT as it switches from an on state to an off state is distributed less heavily to a corresponding pixel electrode and more heavily to a corresponding source line, which typically has a lower impedance than the pixel electrode. This may reduce effects related to voltage kickback errors that may cause visual display artifacts to appear, such as flicker. Moreover, while the embodiments discussed above illustrate the control of the slew rate of a gate activation signal provided to an LCD panel, it should be appreciated that the slew rate control techniques disclosed herein may also be used to control the slew rate of any type of signal used in electronic devices, including data signals (e.g., image data sent to source lines of the LCD panel), control signals, clock signals, and so forth.

As will be understood, the various techniques described above and relating to slew rate control of a signal are provided herein by way of example only. Accordingly, it should be understood that the present disclosure should not be construed as being limited to only the examples provided above. Further, it should be appreciated that the slew rate control disclosed herein techniques may be implemented in any suitable manner, including hardware (suitably configured circuitry), software (e.g., via a computer program including executable code stored on one or more tangible computer readable medium), or via using a combination of both hardware and software elements. For instance, in some embodiments, software routines may be used to determine the state(s) of the control signal(s) 134 for controlling the current $I_{B1}$ and/or $I_{B2}$.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method comprising:

providing a gate driver circuit comprising a rail-to-rail operational amplifier configured to receive a high supply rail voltage and a low supply rail voltage, the operational amplifier having an output stage configured to provide a gate activation signal that is based upon one of the high supply rail voltage or the low supply rail voltage as a supply rail value of the amplifier for switching a selected row of transistors in a display panel, wherein the output stage comprises a compensation capacitance and a current source configured to provide a bias current; and using a programmable slew rate control circuit to adjust a slew rate of the gate activation signal provided by the operational amplifier, wherein adjusting a slew rate of the gate activation signal comprises adjusting the bias current provided by the current source, wherein the current source comprises a programmable current mirror including a reference current system configured to adjust a reference current and a mirror system outputting the bias current mirrored to the adjusted reference current, wherein the reference current system includes at least two transistors arranged in parallel, each of which corresponds to a programmable switch, and wherein adjusting the bias current comprises selectively opening or closing the programmable switches corresponding to the transistors of the reference current system.

2. The method of claim 1, wherein the slew rate of the gate activation signal is controlled independently of RC time constant variables of the output stage of the operational amplifier.

3. The method of claim 1, wherein the slew rate of the gate activation signal is determined as the ratio of the bias current to the compensation capacitance multiplied by the gain of the operational amplifier.

4. The method of claim 3, wherein using the slew rate control circuit to adjust a slew rate of the gate activation signal comprises increasing the bias current to increase the slew rate and decreasing the bias current to decrease the slew rate.

5. The method of claim 1, wherein using the slew rate control circuit to adjust a slew rate of the gate activation signal comprises using a current minoring circuit to control the bias current.

6. The method of claim 1, wherein adjusting the slew rate of the gate activation signal using the slew rate control circuit comprises decreasing the slew rate to reduce the amount of channel charge that is distributed to a respective pixel electrode coupled to each of the selected row of transistors when the selected row of transistors is switched off by the gate activation signal.

7. A gate driver circuit comprising:

an input configured to receive timing information used to switch transistors of a display panel;

a rail-to-rail operational amplifier having an output stage configured to provide an output signal based upon the timing information, wherein the output signal is based upon a supply rail value of the amplifier, wherein the output signal is used to control the switching of the transistors of the display panel, and wherein the output stage comprises a first transistor coupled to a first supply rail, a first current source configured to provide a first bias current, a first compensation capacitor coupled between a gate and an output of the first transistor, a second transistor coupled to a second supply rail, a second current source configured to provide a second bias current, and a second compensation capacitor coupled between a gate and an output of the second transistor; and a programmable slew rate control circuit including at least two transistors arranged in parallel configured to control the slew rate of the output signal by adjusting at least one of the first bias current or the second bias current through active modification of the first current source or the second current source, respectively.

8. The gate driver circuit of claim 7, wherein the first transistor comprises a p-type transistor and the second transistor comprises an n-type transistor.

9. The gate driver circuit of claim 8, wherein adjusting the first bias current controls the slew rate at a rising edge of a pulse in the output signal, and wherein adjusting the second bias current controls the slew rate at a falling edge of the pulse in the output signal.

10. The gate driver circuit of claim 9, wherein increasing the first bias current decreases the transition time of the rising edge and decreasing the first bias current increases the transition time of the rising edge; and wherein increasing the second bias current decreases the transition time of the falling edge and decreasing the second bias current increases the transition time of the falling edge.

11. The gate driver circuit of claim 7, wherein the slew rate control circuit comprises:

a third current source configured to provide a reference current;

the at least two transistors arranged in parallel and each having substantially the same impedance, wherein a gate of each of the at least two transistors is coupled to a gate of a transistor of the first current source; and first switching logic configured to select at least a subset of the at least two transistors;

wherein the first bias current provided by the first current source is substantially equal to the reference current divided by a number of transistors of the at least two transistors selected by the first switching logic.

12. The gate driver circuit of claim 11, wherein increasing the number of selected transistors of the at least two transistors decreases the first bias current and causes the slew rate of the output signal to decrease, and wherein decreasing the number of selected transistors of the at least two transistors increases the first bias current and causes the slew rate of the output signal to increase.

13. The gate driver circuit of claim 11, wherein the slew rate control circuit comprises:

a fourth current source configured to provide a reference current;

a second set of transistors arranged in parallel and each having substantially the same impedance, wherein a gate of each of the second set of transistors is coupled to a gate of a transistor of the second current source; and second switching logic configured to select at least a subset of the second set of transistors;

wherein the second bias current provided by the second current source is substantially equal to the reference current divided by the number of transistors of the second set selected by the second switching logic.

14. A display device comprising:

a display panel comprising an array of pixels arranged in rows and columns, each pixel comprising a thin-film-transistor (TFT) and a pixel electrode;

source driver circuitry configured to send image data to source lines of the display panel, wherein each column of pixels is coupled to a respective source line; and a gate driver circuitry comprising an output circuit comprising a rail-to-rail operational amplifier, wherein the output circuit is configured to provide a gate activation signal that is based upon a supply rail value of the amplifier to gate lines of the display panel, wherein each row of pixels is coupled to a respective gate line, and wherein the gate driver circuit comprises programmable slew rate control logic including at least two transistors arranged in parallel configured to adjust the slew rate of the gate activation signal by adjusting a bias current through active modification of a current source producing the bias current.

15. The display device of claim 14, wherein the rail-to-rail operational amplifier comprises an output stage having a current source configured to provide a biasing current and a capacitor configured to provide a compensation capacitance.

16. The display device of claim 15, wherein the slew rate of the gate activation signal is substantially equal to the value of the biasing current divided by the product of the compensation capacitance and the gain of the operational amplifier.

17. The display device of claim 16, wherein the slew rate control logic is configured to adjust the slew rate of the gate activation signal by increasing or decreasing the biasing current.

18. The display device of claim 17, wherein the slew rate control logic comprises:

a current minoring circuit having the at least two transistors arranged in parallel and coupled to the current source;

switching circuitry comprising a plurality of switches configured to select at least a subset of the at least two transistors, each of the plurality of switches corresponding to a respective one of the at least two transistors and being responsive to a respective control signal to have an opened state or a closed state, wherein an opened state deselects a corresponding transistor and the closed state selects a corresponding transistor; and another current source configured to provide a reference current;

wherein the biasing current provided by the current source is substantially equal to the reference current divided by the number of selected transistors from the at least two transistors.

19. The display device of claim 18, wherein the slew rate control logic comprises a control register configured to store a set of values corresponding to control signals for controlling the states of each of the plurality of switches.

20. The display device of claim 14, wherein the slew rate control logic is configured to control the slew rate of the gate activation signal to reduce the amount of error charge distributed to the pixel electrodes of a selected row of pixels when the TFTs of the selected row are switched off by the gate activation signal.

21. The display device of claim 14, wherein the display device comprises a liquid crystal display panel.

22. An electronic device comprising:

one or more input structures;

a storage structure encoding one or more executable routines;

a processor capable of receiving inputs from the one or more input structures and of executing the one or more executable routines; and a display device configured to display an output of the processor, wherein the display device comprises:

a liquid crystal display (LCD) panel comprising a plurality of pixels arranged in rows and columns, wherein each of the plurality of pixels comprises a thin-film-transistor (TFT) and a pixel electrode, wherein each column of pixels corresponds to a source line of the LCD panel, and wherein each row of pixels corresponds to a gate line of the LCD panel;

a source driver circuit configured to send image data to source lines of the LCD panel;

a gate driver circuit having an output circuit configured to provide a gate activation signal to gate lines of the LCD panel, wherein the gate driver circuit comprises a rail-to-rail operational amplifier having a output stage configured to output the gate activation signal that is based upon a supply rail value of the amplifier and comprising a compensation capacitor and a current source configured to provide a bias current; and a current adjusting circuit configured to control the bias current, wherein varying the bias current through active modification of the current source via at least two transistors arranged in parallel adjusts the slew rate of the gate activation signal.

23. The electronic device of claim 22, wherein the slew rate is proportional to the value of the bias current such that increasing the bias current increases the slew rate of the gate activation signal and decreasing the bias current decreases the slew rate of the gate activation signal.

24. The electronic device of claim 22, wherein the current adjusting circuit is configured to control the bias current using a current mirroring circuit that divides a reference current between a number of the at least two transistors selected from substantially identical transistors arranged in parallel as the at least two transistors, wherein the bias current is controlled by increasing or decreasing the number of selected transistors.

25. The electronic device of claim 22, wherein the bias current is controlled to provide a slew rate that reduces the appearance of visual artifacts in the LCD panel due to effects of voltage kickback error.

26. The electronic device of claim 22, comprising at least one of a laptop computer, a desktop computer, a portable media player, a mobile phone, a tablet computing device, or some combination thereof.

27. A method for operating a display having rows and columns of pixels comprising:

using a gate driver circuit comprising an operational amplifier having an output circuit configured to generate a gate activation signal that is based upon one of a high supply rail voltage or a low supply rail voltage as a supply rail value of the operational amplifier;

using the gate activation signal to switch on a set of transistors corresponding to selected row of pixels;

driving voltages representative of image data to the pixels of the selected row and storing the voltages as charges in pixel electrodes of the selected row of pixels;

using the gate activation signal to switch off the set of transistors; and using a slew rate control circuit to control the slew rate of the gate activation signal independently of resistance (R) and capacitance (C) time constants of the output circuit through active modification of the current source to adjust rise and fall times of the gate activation signal to be equivalent, wherein an amount of error charge distributed to the pixel electrodes of the selected row of pixels due to channel charge behavior of the set of transistors does not result in visual artifacts related to voltage kickback effects to be perceivable by the human eye on the display, wherein the current source comprises a programmable current minor including a reference current system configured to adjust a reference current and a mirror system outputting the bias current mirrored to the adjusted reference current, wherein the reference current system includes at least two transistors arranged in parallel, each of which corresponds to a programmable switch, and wherein the active modification of the current source comprises selectively opening or closing the programmable switches corresponding to the transistors of the reference current system.

28. The method of claim 27, wherein using the slew rate control circuit to control the slew rate of the gate activation signal comprises varying a biasing current of the current source.

* * * * *